United States Patent [19]

Geppelt et al.

[11] 4,317,353

[45] Mar. 2, 1982

[54] TUBE TWISTING APPARATUS

[75] Inventors: Elmo W. Geppelt; William H. Poore, both of Tulsa, Okla.

[73] Assignee: Delta t Limited, Tulsa, Okla.

[21] Appl. No.: 106,950

[22] Filed: Dec. 26, 1979

[51] Int. Cl.[3] ..... B21D 11/14

[52] U.S. Cl. ..... 72/299; 72/11; 72/23; 72/371

[58] Field of Search ..... 72/299, 371, 11, 12, 72/16, 23, 24

[56] References Cited

U.S. PATENT DOCUMENTS

| | | | |
|---|---|---|---|
| Re. 24,783 | 2/1960 | Humphrey | 72/299 |
| 3,015,355 | 1/1962 | Humphrey | 72/299 |
| 3,533,267 | 10/1970 | Bunnell | 72/299 |
| 4,059,004 | 11/1977 | Perkins | 72/299 |

*Primary Examiner*—Daniel C. Crane
*Attorney, Agent, or Firm*—Head & Johnson

[57] ABSTRACT

An automated apparatus for forming helical corrugations in a cylindrical tube and comprising a tail stock movable in alternate forward and reverse directions, a head stock disposed in spaced relation with respect to the tail stock whereby the tube may be supported therebetween in a manner for rotating one end of the tube about its own longitudinal axis while holding the opposite end against rotation for twisting the wall of the tube to form the corrugations, a sensor device for detecting the progression of the corrugations along the length of the tube whereby forward movement of the tail stock and forward rotation of the head stock is stopped in accordance with a predetermined position in the twisting operation and the tail stock and head stock are actuated in reverse directions for a controlled unwinding and stretching of the twisted tube, a first sensor device responsive to the reverse movement of the tail stock for releasing the engagement of the twisted tube for permitting removal of the tube from the apparatus, a second sensor device responsive to the continued reverse movement of the tail stock for stopping the operation of the apparatus in preparation for a next succeeding tube twisting operation, and an automated apparatus for inserting a mandrel through the tube prior to the twisting operation for control of the inner diameter of the corrugations.

8 Claims, 8 Drawing Figures

TUBE TWISTING APPARATUS

1. Field of the Invention

This invention relates to improvements in tube twisting apparatus and more particularly, but not by way of limitation, to an automated tube twisting apparatus for producing in succession multiple twisted tubes of a controlled helical corrugation pattern and of uniform overall length with uniformity between substantially any desired number of twisted tubes.

2. Description of the Prior Art

Finned tubes have long been utilized in the heat exchanger industry, and the like, for improving the dissipation of heat. Many of the tubes in use today comprise a cylindrical tube having a plurality of longitudinally spaced radially extending fins secured to the outer periphery thereof, and in some instances the tubes are provided with a continuous helical fin secured to the outer periphery of the tube. The inner periphery of these tubes is normally smooth and whereas the fins on the outer periphery of the tube improve the operation of the heat exchanger, the inner periphery does not provide any material increased effect in the efficiency of the tube. It has been found that twisting of the walls of the tube itself in order to deform the tube into a helical corrugated configuration along the length thereof provides an event more efficient heat dissipation in a heat exchanger in that both the inner and outer peripheries of the tube are deformed.

Many devices have been developed for twisting cylindrical tubes to provide the desired helical corrugations therealong, such as those shown in the Humphrey U.S. Pat. No. Re. 24,783, issued February, 1960; the Humphrey U.S. Pat. No. 3,015,355, issued January, 1962, and the Bunnell U.S. Pat. No. 3,533,267, issued October 1970. These devices have certain disadvantages however, in that it is difficult to control the uniformity of the corrugations along the length of the tube and the overall length of the completed tube, and thus it is very difficult to produce a plurality of tubes of uniform diametric and longitudinal dimensions. As a consequence, it becomes difficult, if not impossible, to assemble a plurality of the tubes in a heat exchanger, or the like, since the variations in tube size creates a problem in the installation of the tubes. Usually time must be consumed in sorting through a plurality of the tubes to find those of substantially identical dimensions, or a plurality of the tubes must be discarded as unusable in a particular installation. This procedure is time consuming and expensive.

SUMMARY OF THE INVENTION

The present invention contemplates an automatic apparatus for twisting tubes to provide a helical corrugation extending substantially throughout the length of the tube and which has been particularly designed and constructed for overcoming the foregoing disadvantages. The novel apparatus comprises a lathe-type machine having a head stock or collet for receiving one end of the tube therein in order to rotate the said end about the longitudinal axis of the tube, and a tail stock member spaced from the head stock and movable in alternate forward and reverse directions with respect thereto. A suitable sensor is provided for detecting the advance of the corrugations along the length of the tube during the twisting operation, and is operable connected with the head stock and tail stock through a suitable clutching mechanism for stopping the forward movement of both the tail stock and rotation of the head stock when the corrugations have reached a preselected point along the length of the tube and initiating a reverse movement for both the tail stock and head stock for a controlled unwinding and stretching of the twisted tube. A first sensor device is provided for response to the reverse movement of the tail stock for releasing the engagement of the tail stock with the tube upon a preselected length of reverse movement of the tail stock, and a second sensor device is provided for detecting the continued reverse movement of the tail stock and stopping all machine operation when the tail stock has reached a predetermined position along the bed of the machine whereby the apparatus is ready for the next succeeding tube twisting operation. Means is also provided for automatically inserting a mandrel through the tube prior to the twisting of the tube, and the position of the mandrel is controlled by suitable limit switch means. In this manner substantially any desired number of twisted tubes having a common diametric helical and longitudinal dimension may be produced. The novel apparatus is simple and efficient in operation and economical and durable in construction.

DESCRIPTION OF THE PREFERRED EMBODIMENT

Figure 1:
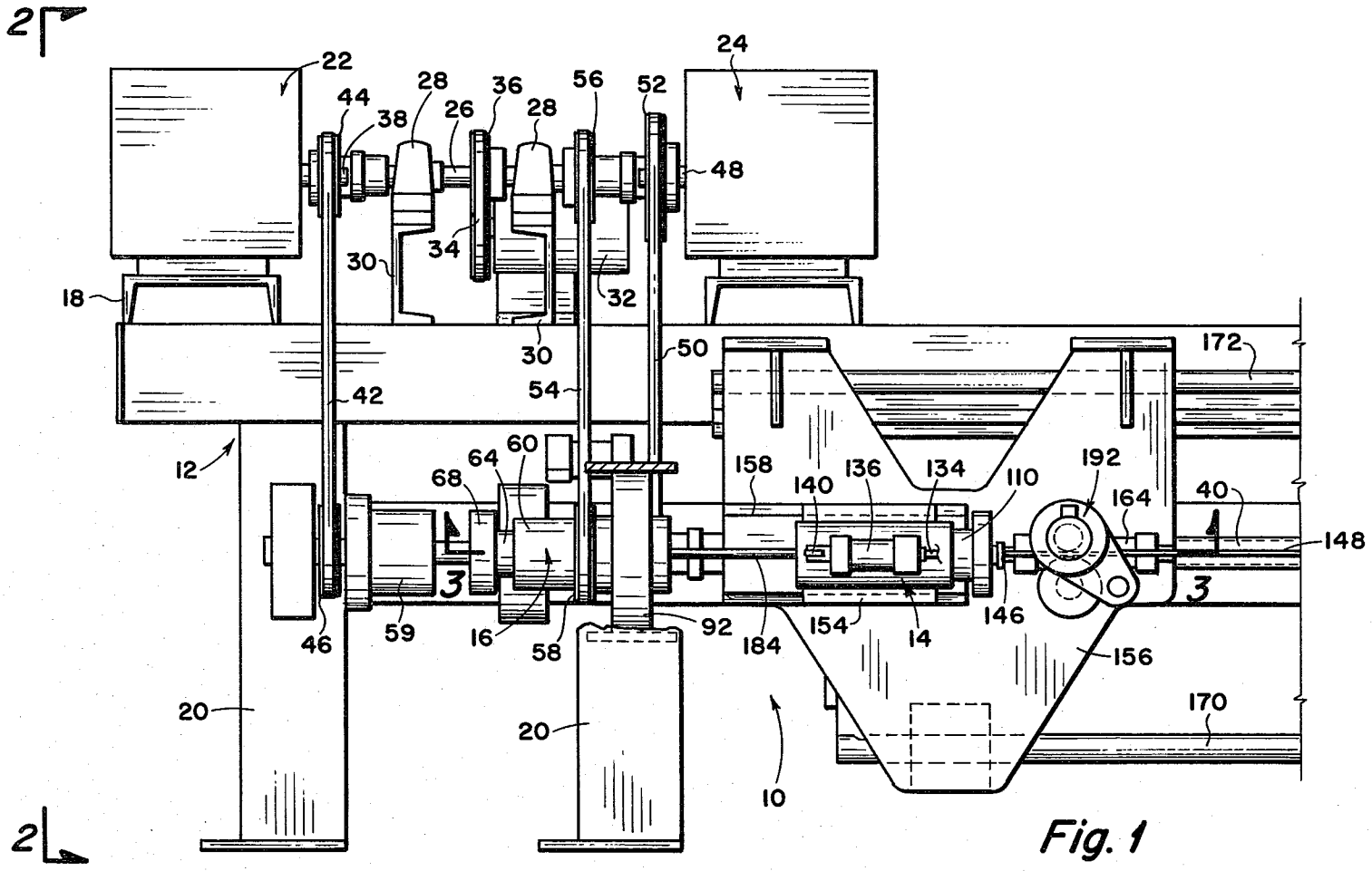
FIG. 1 is a side elevational view of an apparatus embodying the invention, with portions thereof eliminated for purposes of illustration.

Referring to the drawings in detail, reference character 10 generally indicates an automated tube twisting apparatus embodying the invention and comprising a suitable frame 12, preferably generally similar to a lathe, having a tail stock assembly 14 mounted thereon for movement in alternate forward and reverse directions, and a head stock or collet assembly 16 secured thereon in spaced relation to the tail stock 14. The frame 12 includes a substantially horizontally disposed bed 18 supported by suitable spaced legs 20. A pair of suitable gear reduction units 22 and 24 are mounted on the upper surface of the bed 18 in any suitable or well known manner. The gear reduction units 22 and 24 are provided with a common input shaft 26 which may either be a single shaft extending between the two units, or may comprise a pair of shafts disposed in axial alignment and suitably coupled together in end-to-end relation for simultaneous rotation thereof about the longitudinal axis. The shaft 26 is supported above the bed 18 by suitable pillow block bearings 28, which may be secured to the bed in any well known manner, such as by channel members 30 as shown in FIG. 1.

The input shaft 26 is driven by a suitable revisible motor 32, such as a hydraulic motor but not limited thereto, which is secured to the bed 18 in any well known manner and is operably connected with the shaft 26 by a belt 34 and pully 36 for rotation of the shaft 26. The gear reduction unit 22 is provided with an output shaft 38 which is operably connected with a lead screw 40 by an endless belt 42 extending between and around pulley members 44 and 46 for rotation of the lead screw 40 about its own longitudinal axis as is well known and as will be hereinafter set forth in detail. The gear reduction unit 24 is also provided with an output shaft 48 preferably disposed in substantial axial alignment with the shaft 38 and operably connected with the set screw 40 through an endless belt 50 and a pair of spaced pulleys 52 (only one of which is shown in the drawings) for transmitting rotation to the lead screw 40 as will be hereinafter set forth. The input shaft 26 is operably connected with the head stock assembly 16 through an endless belt 54 and a pair of spaced pulleys 56 and 58 for rotation of the head stock as will be hereinafter set forth. In addition, a suitable reversible clutch means 59, preferably an air actuated clutch but not limited thereto, is operably connected between the motor 30 and lead screw drive mechanisms in any well known manner for controlling the direction of movement of the tail stock assembly 14 during operation of the apparatus 10.

Figure 3:
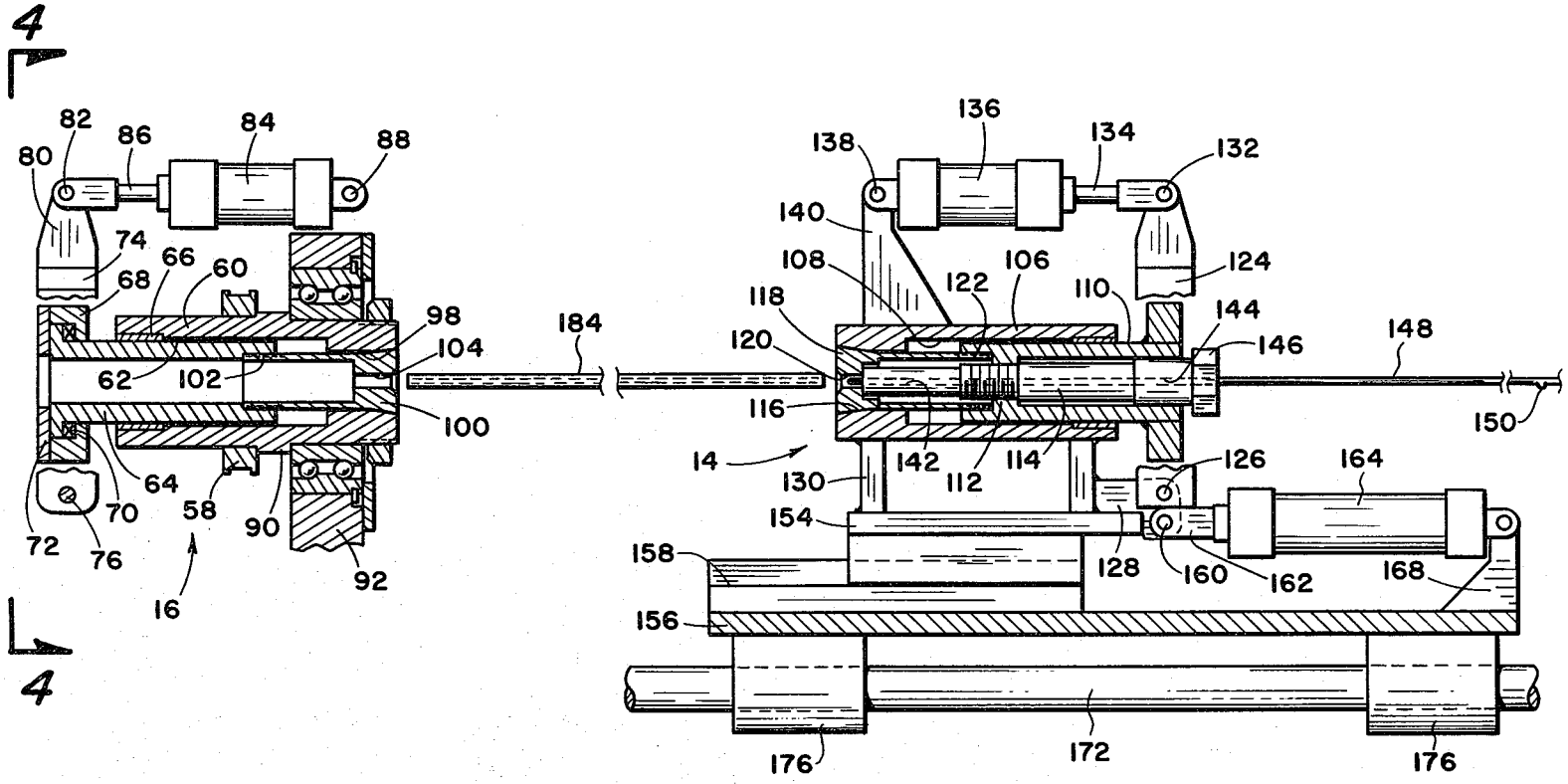
FIG. 3 is a view taken on line 3—3 of FIG. 1.
Figure 6:
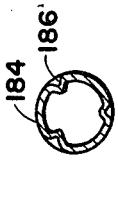
FIG. 6 is a view taken on line 6—6 of FIG. 5.

As more particularly shown in FIG. 3, the head stock or collet assembly 16 comprises an outer housing 60 having a centrally disposed bore 62 extending longitudinally therethrough for receiving a flanged sleeve 64 through one end thereof. A suitable bushing sleeve, or the like, 66 is interposed between the inner periphery of the bore 62 and the outer periphery of the sleeve 64 for wedging the sleeve 64 securely within the housing 60 whereby the housing and sleeve may be rotated about the common longitudinal axis thereof by the pulley 58. The outer pulley 58 may be keyed or otherwise secured to the outer periphery of the housing 60 for transmitting said rotation thereto during operation of the apparatus 10.

Figure 4:
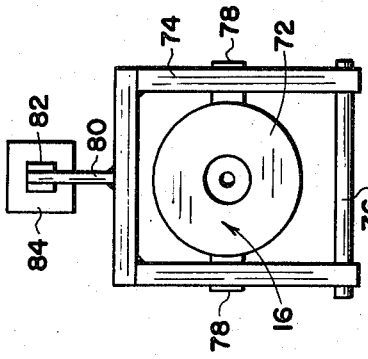
FIG. 4 is a view taken on line 4—4 of FIG. 3.

The outer end of the sleeve 64 is journalled within an apertured cap member 68 by suitable bearings 70, and an apertured end plate 72 is suitably secured to the outer end of the cap for retaining the flanged sleeve 64 in position with relation thereto. A substantially inverted U-shaped bracket 74 (FIG. 4) surrounds the outer periphery of the cap member 68 and is pivotally secured to the frame 12 in any suitable manner, such as by a pin member 76 extending between the spaced lower legs of the U-bracket 74. The cap 68 is pinned or otherwise secured to the legs of the U-bracket 74 as shown at 78 in FIG. 4, and an apertured flange 80 extends outwardly from the cross member of the U-bracket 74 for pivotal connection at 82 with a suitable solenoid 84, or cylinder having a reciprocal actuator arm 86. The cylinder 84 is pivotally secured to the frame 12 in any suitable manner such as pivot pin 88. When the cylinder 84 is activated for extension of the arm 86, the U-bracket 74 is pivoted in a counter clockwise direction about the pivot pin 76, as viewed in FIG. 3, for pulling the sleeve 64 in one direction within the bore 62 for providing said wedging engagement between the sleeve and the housing 60, and upon retraction of the arm 86, the pivotal movement of the U-bracket 74 is reversed for moving the sleeve 64 in an opposite direction within the housing 60 for releasing the wedging engagement therebetween, for a purpose as will be hereinafter set forth.

Figure 2:
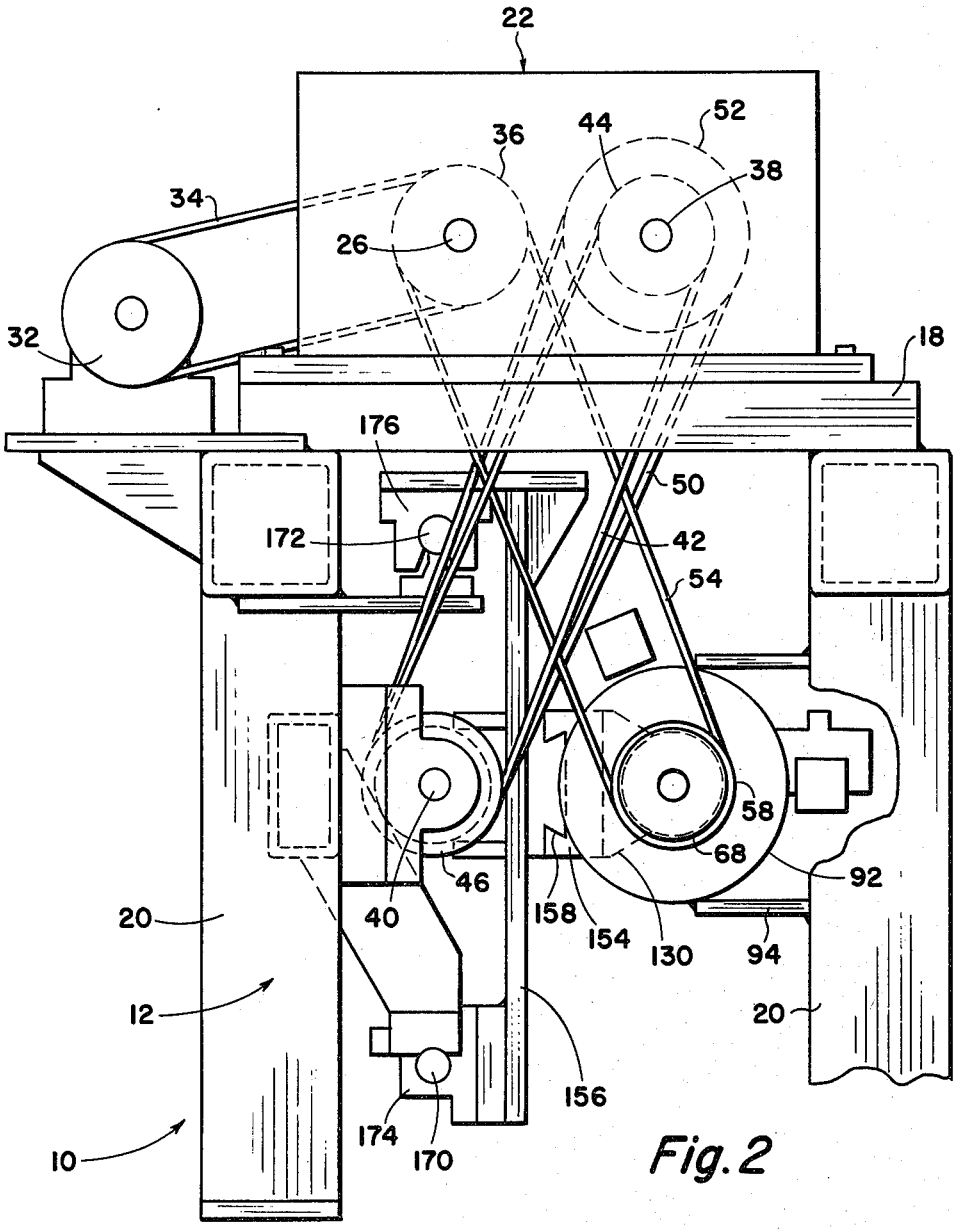
FIG. 2 is a view taken on line 2—2 of FIG. 1.

An annular shoulder 90 is provided on the outer periphery of the housing 60 for receiving the pulley 58 against one side thereof and for supporting a suitable bearing housing 92 on the opposite side thereof. The bearing housing 92 is secured in position around the outer periphery of the housing 60 in any well known or suitable manner, and the outer periphery of the bearing housing 90 is rigidly secured to the frame 12 in any suitable manner, such as the support plates 94 and 96 as shown in FIG. 2. The housing 60 is thus secured to the frame 12 for free rotation about its own longitudinal axis upon actuation by the pulley 58. In addition, the bore 62 is reduced at 98 and is of a suitable cross-sectional configuration for slidably receiving a tapered sleeve member 100 therein. The inner end of the sleeve 100 is threadedly secured to the inner end of the sleeve 64 as shown at 102 in FIG. 3, and the outer portion of the sleeve 100 is preferably provided with a plurality of longitudinally extending slits (not shown) through the sidewall thereof. The outer end of the sleeve 100 is provided with a centrally disposed longitudinally extending bore 104, and upon movement of the sleeve 100 in one direction with respect to the bore 60, the wall segments of the sleeve 100 formed by the circumferentially spaced slits permits the sidewalls of the sleeve 100 to expand slightly for a slight increase in the diameter of the bore 102, and movement of the sleeve 100 in an opposite direction with respect to the bore 60 securely wedges the outer periphery of the sleeve in the reduced bore portion 98 and reduces the diameter of the bore 100.

The tail stock assembly 14 comprises an outer housing 106 having a centrally disposed bore 108 extending longitudinally therethrough for receiving a flanged sleeve 110 therein. An annular shoulder 112 is provided on the inner periphery of the sleeve 110 and is threaded for receiving a guide sleeve 114 there through. The bore 108 is of a reduced diameter at 116 and is outwardly tapered at the outer end thereof for cooperating with a wedging sleeve 118 generally similar to the sleeve 110. The sleeve 118 is provided with a centrally disposed bore 120 similar to the bore 104, and the sidewall of the sleeve surrounding the bore 120 is provided with a plurality of circumferentially spaced longitudinally extending slits whereby movement of the sleeve 118 in one direction within the bore 108 will permit the wall to flex slightly outwardly for increasing the diameter of the bore 120, and movement of the sleeve 118 in an opposite direction will wedge the sleeve within the bore 116 and reduce the diameter of the bore 120. The inner end of the sleeve 118 is threadedly secured to the inner end of the sleeve 110 as shown at 122 whereby the sleeves 110 and 118 move as a unit within the bore 108.

The outer end of the sleeve 110 is preferably provided with a bracket 124 generally similar to the U-bracket 74 and having a pivot pin 126 pivotally connecting the bracket 124 with a flange 128 which is rigidly secured to a support means 130, which in turn is rigidly secured to the outer periphery of the housing 106. The opposite side of the bracket 124 is pivotally secured at 132 to an extendable arm 134 of a solenoid or cylinder 136, and the cylinder is pivotally secured at 138 to an outwardly extending flange 140 secured to the outer periphery of the housing 106. When the cylinder 136 is activated for extending the arm 134, the sleeve 110 is moved in one direction with respect to the bore 108 for increasing the size of the bore 120, and when the arm 134 is moved to a retracted position with respect to the cylinder 136 the sleeve 110 is moved in a direction for decreasing the size of the bore 120, for a purpose as will be hereinafter set forth.

The guide sleeve 114 is provided with an internal bore 142 in substantial alignment with the bore 120 and extending longitudinally from the bore into communication with a corresponding bore 144 provided in an end plug 146 which is inserted through the outer end of the bore 108 as shown in FIG. 3. During operation of the apparatus 10, a mandrel 148 is inserted through the guide sleeve 114 and therebeyond in a direction toward the head collet assembly 16. An outwardly extending nipple, flange, or the like, as shown at 150 for engagement with a sensor device 152 in order to limit the movement of the mandrel in the direction toward the head collect 16.

The support means 130 is rigidly secured to a plate member 154 which is reciprocally secured to a movable plate member 156 by means of a dove-tail connection therebetween as particularly shown at 158 in FIG. 2. The flange 128 is pivotally secured at 160 to the extendable arm 162 of a suitable solenoid or cylinder 164, and the cylinder 164 is pivotally secured at 166 to a flange 168 which is secured to the plate 156. In this manner, alternate extension and retraction of the arm 164 moves the plate 154 reciprocally with respect to the plate 156 for moving the tail stock assembly 14 reciprocally with respect to the plate 156 for a purpose as will be hereinafter set forth.

The plate 156 is slidably secured to a pair of spaced mutually parallel guide rods 170 and 172 by suitable support bushings 174 and 176 whereby the plate 156 may be freely reciprocated along the guides 170 and 172, as is well known. The guide rods 170 and 172 are rigidly secured to the frame 12 in any suitable or well known manner and extend longitudinally substantially throughout the length of the bed 18, but preferably terminate in spaced relation to the belt and pulley drive assemblies. A suitable sensor device means 180, such as a micro-switch or the like, is movably secured to the frame 12 in any suitable manner for engagment by the plate 156 during movement thereof in a direction away from the head collet assembly 16. The switch 180 is operably connected with the cylinders 84 and 136 for opening of the respective bores 104 and 120 upon engagement of the switch 180 by the plate 156. Still another sensor device 182 is secured to the frame 12 in the proximity of the outer end thereof remotely disposed from the belt and pulley drives for limiting or stopping the movement of the plate 156 in the direction away from the head collet, thus placing the tail stock in a position for commencing a next succeeding tube twisting operation.

Figure 5:
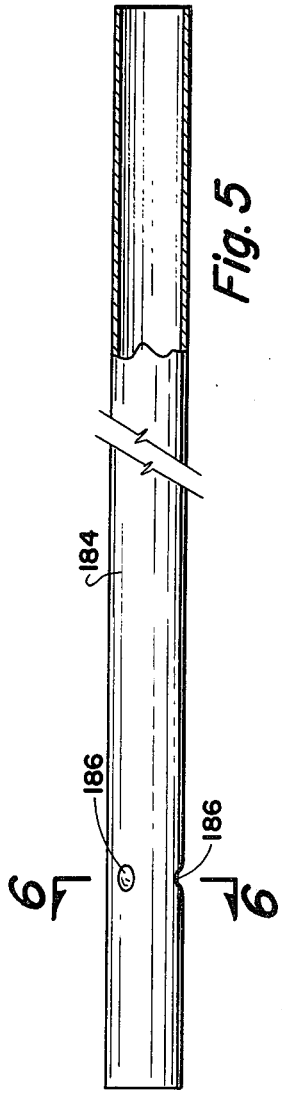
FIG. 5 is a side elevational view, partly in section, of a typical cylindrical tube as prepared to be twisted by the apparatus of the invention.
Figure 7:
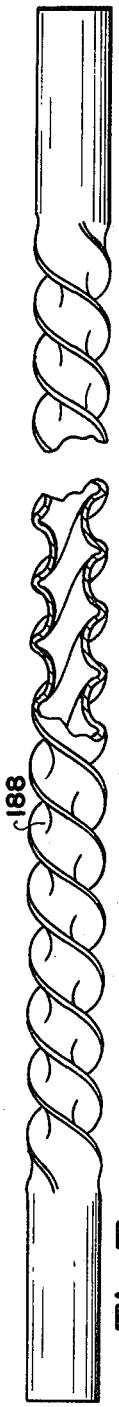
FIG. 7 is a view of a tube as twisted by the apparatus of the invention.
Figure 8:
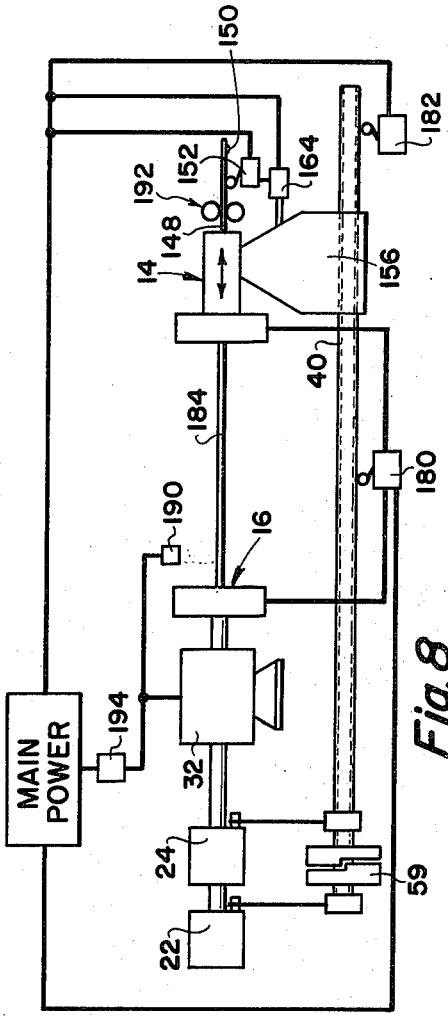
FIG. 8 is a schematic view of an operating circuit for an apparatus embodying the invention.

During a tube twisting operation, cylindrical tube 184 to be twisted is positioned between the tail stock assembly 14 and the head stock assembly 16, with one end of the tube being inserted within the bore 104 and the opposite end of the tube being inserted within the bore 120. The tube 184 is provided with a plurality of circumferentially spaced dimples 186 in the sidewall thereof and spaced at a preselected distance inboard of one end of the tube, as particularly shown in FIG. 5. As one end of the tube 184 is rotated while the opposite end thereof is held against rotation, the walls of the tube begin to twist, forming a helical corrugation 188 along the length of the tube 1. The corrugations begin at the dimples 186, and it is thus important to position the dimples inboard of the respective tube end at a distance wherein it is desired to initiate the corrugations on the tube. As the twisting operation continues, the corrugations travel along the length of the tube and a suitable sensor means 190, such as an electric photo cell, is provided in the proximity of the undimpled end of the tube and is activated the moment the corrugations reach the preselected position in line with the sensor. The sensor 190 is operably connected with the clutch 59 and motor 30 for reversing the operation of the head collet and rotation of the lead screw 40 for a purpose as will be hereinafter set forth.

A roller assembly generally indicated at 192 is provided in the proximity of the outboard or rearward end of the tail stock 14 and is engageable with the outer periphery of the mandrel 148 for moving the mandrel in alternate forward and reverse directions during operation of the apparatus 10. In the forward direction, the mandrel is inserted through the tail stock assembly 14 and forwardly through the head stock 16. In the reverse direction, the mandrel is withdrawn from the head collet and tail stock.

In use, the operation of the apparatus 10 is substantially entirely automated. The operator of the machine or apparatus 10 initially sets the machine for the particular end results required, as is well known, adjusts the position of the sensor devices in accordance with the dimensions of the tubes to be twisted and the desired end product. Subsequent to the initial "set up", the dimpled end of the tube 184 is inserted into the bore 120 of the tail stock assembly, and the cycle start switch or buttom 194 is engaged. The operational cycle begins by actuation of the cylinder 136 for closing of the bore 120 against the outer periphery of the tube 184. The assembly 192 then inserts the mandrel 148 into the bore 144, through the tube 184 and through the sleeve 64 of the head stock 16. When the projection member 150 engages the sensor device 152, the forward movement of the mandrel is stopped. The cylinder 164 is then activated for moving the tail stock assembly 14 in a forward direction along the dove-tail connection 158. This forward distance through which the tail stock 14 moves is selected in accordance with the distance required for inserting the outer or free end of the tube 184 into the bore 104 of the head stock 16, whereupon the cylinder 84 is activated for closing the bore 104 around the outer periphery of the tube 184. The motor 30 is then activated for rotating the head collet and initiating the twisting of the tube 184 and the feed screw clutch 59 is engaged for rotating the feed screw 40 and advancing the plate 156 in a direction toward the head collet 16. This moves the tail stock assembly 14 in a forward direction, or toward the head stock 16.

The twisting of the tube 184 causes the wall of the tube to begin forming into a helical corrugation at the dimples 186, and upon a continued rotation of the head stock 16, the corrugation moves forwardly along the length of the tube. The mandrel 148 extending through the length of the tube 184 prevents a collapse of the walls of the tube and limits the inner diameter of the corrugations being formed in the walls of the tube. As soon as the corrugation moves to a position of alignment with the sensor 190, the clutch 59 is activated for reversing the direction of rotation of the lead screw 40 and reversing the direction of the motor 30. At this time, the tube 184 is untwisted to release the mandrel and the length of the twisted tube is stretched through a preselected distance, whereupon the sensor device 180 is engaged by the plate 156. This actuates the cylinders 84 and 136 for releasing the clamping engagement of the bores 104 and 120 with the tube 184, and activates the assembly 192 for withdrawing the mandrel 148 from the tube and tail stock. The tail stock continues to move in the rearward direction, or away from the head collet 26 until the plate 156 engages the rearmost sensor device 182, whereupon the tail stock is in a position for commencing the next succeeding tube twisting operation. It will be readily apparent that substantially any desired number of twisted tubes of substantially identical dimensions and configurations may be produced by the apparatus, thus greatly facilitating the ultimate use of the twisted tubes.

Whereas the present invention has been described in particular relation to the drawings attached hereto, it should be understood that other and further modifications, apart from those shown or suggested herein may be made within the spirit and scope of this invention.

What is claimed is:

1. An automated apparatus for twisting cylindrical tubes and comprising a support frame having a rotatable head collet and a reciprocal tail stock mounted thereon for supporting the tube therebetween, drive motor means, first drive means operably connected between the motor means and the head collet for actuation of the head collet, second drive means operably connected between the motor means and the tail stock for providing said reciprocal movement therefor, first cylinder means operably connected with said tail stock for alternately opening and closing thereof for receiving and clamping one end of the tube therein, second cylinder means operably connected with the head collet for opening and closing thereof for receiving and securing the opposite end of the tube therein, mandrel means for insertion through the tail stock and tube and head collet, means operably connected with said tail stock providing for limited forward reciprocal movement thereof prior to the initiation of the twisting operation, means operably connecting the tail stock to a lead screw for controlled reciprocal movement of the tail stock, sensing means responsive to the length of the progression of the twisting along the tube during a tube twisting operation for reversing the movement of the head collet and tail stock for a controlled unwinding and stretching of the twisted tube, sensor device means operably connected with the tail stock for actuation of both said tail stock cylinder and said head collet cylinder upon a preselected distance of reverse movement of the tail stock whereby the cylinders release the clamping engagement of the ends of the tube, means for a controlled insertion and withdrawal of said mandrel from the tail stock and tube and head collet, and final sensor device means for limiting the rearward movement of the tail stock for positioning thereof for the next succeeding tube twisting operation.

2. An automated apparatus for twisting cylindrical tubes as set forth in claim 1 wherein the drive means operably connected between the motor means and the tail stock comprises a first gear drive assembly operably connected with the motor for actuation thereby and operably connected with the tail stock for reciprocal movement thereof, a second gear drive assembly operably connected with the motor and operably connected with the tail stock for cooperation with first gear drive means for providing said reciprocal movement for the tail stock.

3. An automated apparatus for twisting cylindrical tubes as set forth in claim 2 and including lead screw means operably connected between the first and second gear drive assemblies and the tail stock, and reversible clutch means operably connected with the lead screw for selectively reversing the direction of rotation of the lead screw to provide for alternate forward and rearward directions of movement of the tail stock.

4. An automated apparatus for twisting cylindrical tubes as set forth in claim 1 wherein the first drive means comprises first endless belt and pulley means operably connected between the drive shaft of the motor and a rotatable input shaft, and second endless belt and pulley means operably connected between the input shaft and the head collet for rotation of the head collet.

5. An automated apparatus for twisting cylindrical tubes as set forth in claim 1 wherein the drive means operably connected between the motor means and the tail stock comprises first and second gear drive assemblies each having a common input shaft and independent output shafts, endless belt and pulley drive means operably connected between the motor and the input shaft, and separate endless belt and pulley drive means operably connected between each of the gear drive assemblies and the tail stock.

6. An automated apparatus for twisting cylindrical tubes as set forth in claim 5 and including lead screw means operably connected with the tail stock for providing said reciprocal movement therefor, and reversible clutch means connected with the lead screw for selective reversal of the rotation direction thereof to provide said reversible movement for the tail stock.

7. An automatic method of twisting cylindrical tubes which comprises the steps of initially placing one end of the tube to be twisted in a reciprocal tail stock member, manually closing a starting switch for activation of the method, automatically closing the tail stock for clamping of the tube disposed therein, automatically inserting a mandrel through the tail stock and tube, automatically controlling the length of insertion of the mandrel, moving the tail stock member in a direction toward a head stock member for inserting the opposite end of the tube in the head stock, closing the head stock on the tube for securely clamping the tube in the head stock, automatically initiating a rotation of the head stock for twisting the respective end of the tube clamped therein with respect to the opposite end thereof, moving the tail stock through an additional distance in the direction toward the head stock simultaneously with the rotation of the head stock for producing a helical corrugation in the wall of the tube, sensing the travel of the corrugation along the length of the tube, automatically reversing the direction of rotation of the head stock and tail stock at a preselected length of progression of the helical corrugation for a controlled unwinding and longitudinal stretching of the twisted tube, automatically opening the tail stock and head stock upon a preselected length of reverse travel for the tail stock for permitting removal of the twisted tube, automatically withdrawing the mandrel from the twisted tube prior to removal thereof, continuing the reverse movement of the tail stock, and controlling the length of travel during the continued reverse movement of the tail stock for returning the tail stock to the start position for the next succeeding tube twisting operation.

8. An automated apparatus for twisting cylindrical tubes and comprising a support frame having a rotatable head collet and a reciprocal tail stock mounted thereon for supporting the tube therebetween, drive motor means, first drive means operably connected between the motor means and the head collet for actuation of the head collet, second drive means operably connected between the motor means and the tail stock for providing said reciprocal movement therefor, first cylinder means operably connected with said tail stock for alternately opening and closing thereof for receiving and clamping one end of the tube therein, second cylinder means operably connected with the head collet for opening and closing thereof for receiving and securing the opposite end of the tube therein, mandrel means for insertion through the tail stock and tube and head collet, means operably connected with said tail stock providing for limited forward reciprocal movement thereof prior to the initiation of the twisting operation, means operably connecting the tail stock to a feed screw for controlled reciprocal movement of the tail stock, sensing means responsive to the progression of the tube twisting operation for reversing the movement of the head collet and tail stock for a controlled unwinding and stretching of the twisted tube, sensor device means operably connected with the tail stock for actuation of both said tail stock cylinder and said head collet cylinder upon a preselected distance of reverse movement of the tail stock whereby the cylinders release the clamping engagement of the ends of the tube, means for a controlled insertion and withdrawal of said mandrel from the tail stock and tube and head collet, and final sensor device means for limiting the rearward movement of the tail stock for positioning thereof for the next succeeding tube twisting operation, and wherein the drive motor means is a reversible motor, and the sensing means comprises photoelectric cell means operably connected with the motor for reversing the operational direction thereof at a preselected progression of the tube twisting operation to provide said reverse movement of the head collet and tail stock.

* * * * *